US008113972B2

(12) United States Patent
Dobransky

(10) Patent No.: US 8,113,972 B2
(45) Date of Patent: Feb. 14, 2012

(54) BASEBALL BAT

(76) Inventor: Gary E. Dobransky, Johnson City, NY (US)

( * ) Notice: Subject to any disclaimer, the term of this patent is extended or adjusted under 35 U.S.C. 154(b) by 42 days.

(21) Appl. No.: 12/569,267

(22) Filed: Sep. 29, 2009

(65) Prior Publication Data

US 2010/0081525 A1 Apr. 1, 2010

Related U.S. Application Data

(60) Provisional application No. 61/100,876, filed on Sep. 29, 2008.

(51) Int. Cl.
*A63B 59/06* (2006.01)

(52) U.S. Cl. ..... 473/564

(58) Field of Classification Search ..... 473/457, 473/519, 520, 564–568
See application file for complete search history.

(56) References Cited

U.S. PATENT DOCUMENTS

| | | | | |
|---|---|---|---|---|
| 377,686 | A * | 2/1888 | Moose | 473/564 |
| 1,665,195 | A * | 4/1928 | Cohn | 473/520 |
| 2,195,681 | A * | 4/1940 | Robarge | 473/564 |
| 5,165,686 | A | 11/1992 | Morgan | |
| 6,609,984 | B1 * | 8/2003 | Tribble | 473/564 |
| 6,767,299 | B1 | 7/2004 | Chang | |
| 7,140,988 | B1 * | 11/2006 | Hinman | 473/566 |
| 7,448,971 | B1 * | 11/2008 | Smalley | 473/564 |
| 2002/0061796 | A1 * | 5/2002 | Rios | 473/564 |
| 2007/0072711 | A1 | 3/2007 | Mallas | |
| 2008/0308187 | A1 | 12/2008 | Dill | |
| 2010/0292035 | A1 * | 11/2010 | Huang | 473/564 |

* cited by examiner

*Primary Examiner* — Mark Graham
(74) *Attorney, Agent, or Firm* — Brown & Michaels, PC

(57) ABSTRACT

A baseball bat includes a wood portion and a filling material contained by the wood portion. The filling material fills a longitudinal hole in the length of the wood portion to form a cord and a pair of widened portions at either end of the longitudinal portion to form a pair of plugs. The plugs positively contain the wood portion and the cord maintains a connection between the plugs in case of breakage of the wood portion. The filling material is preferably selected such that it does not alter the hitting properties of the baseball bat. In some embodiments the filling material is a polymeric material applied to the hole in a molten state and allowed to cure. In some embodiments the filling material is a mixture of multiple components. Methods of manufacturing a baseball bat are also disclosed.

17 Claims, 1 Drawing Sheet

BASEBALL BAT

REFERENCE TO RELATED APPLICATIONS

This application claims one or more inventions which were disclosed in Provisional Application No. 61/100,876, filed Sep. 29, 2008, entitled "SAFETY BAT". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of baseball. More particularly, the invention pertains to a wooden bat for use in the game of baseball.

2. Description of Related Art

While amateur baseball leagues now use predominantly non-wooden baseball bats, most professional baseball leagues, including Major League baseball, exclusively use wooden bats. A major danger in the use of wooden bats is that they commonly break toward the narrower handle part of the bat when they strike a pitched baseball. Often this break is clean, causing the bat to break into two pieces, where the momentum of the bat barrel combined with the impact of the pitched baseball causes the barrel of the bat to go flying at a high speed toward other players or toward the spectators. The broken end of the barrel typically includes sharp and jagged edges which can cause serious injury when it strikes a person.

The statistics and records from the 125-year history of Major League baseball are based on the use of wooden baseball bats. Only wooden baseball bats formed from a single piece of wood of certain types and within a narrow range of specifications for dimensions and weight are permitted to be used in Major League baseball games. Baseball purists are extremely reticent to allow any type of modification to these bats, because it may change the way in which the batter swings the bat or the way the bat interacts with the ball, thereby providing the batter with either an advantage or a disadvantage with respect to batters using conventional wooden bats. For this reason, no modifications to solid wooden bats have been permitted by Major League baseball.

Modifications to wooden baseball bats to try to strengthen them against breakage are known in the art. Many of these modifications affect the striking surface of the bat including applying a surface coating to the bat and gluing radial pieces of wood together to form the bat. These modifications affect how the bat interacts with a pitched ball and thus would alter the game of baseball if permitted.

Modifications which do not affect the striking surface of the wooden bat are also known. U.S. Pat. No. 1,063,563, issued Jun. 3, 1913 to Lincoln S. May, discloses a wooden baseball bat with steel tubing in a longitudinal hole down the length of the bat to strengthen the bat. This modification alters the hitting properties of the bat and does not prevent the barrel of the bat from separating from the handle upon breakage. U.S. Pat. No. 1,603,904, issued Oct. 19, 1926, and U.S. Pat. No. 1,665,195, issued Apr. 3, 1928, both to Edward Cohn, disclose reinforced wooden baseball bats with metal rods in longitudinal holes down the length of the bats secured at both ends by threaded plugs. While these modifications physically hold the two ends of the bat together after breakage, they also significantly alter the hitting properties of the bat. U.S. Pat. No. 5,165,686, issued Nov. 24, 1992 to Edward H. Morgan, and U.S. Patent Application Publication No. 2007/0072711, by Nicholas D. Mallas published Mar. 29, 2007, disclose wooden baseball bats with a hole through the narrowed handle portion of the bat containing a reinforcement material. While these modifications may strengthen the narrowed portion of the bat, they do not always prevent the separation of the barrel from the handle when the bat breaks.

There is a need in the art for a wooden baseball bat that conforms to the specifications, dimensions, and hitting properties of wooden bats used in Major League baseball and, when broken by contact with a pitched baseball, does not separate into a handle portion and a projectile portion, which may injure players or spectators.

SUMMARY OF THE INVENTION

A baseball bat of the present invention includes a wood portion and a filling material contained by the wood portion. The filling material fills a longitudinal hole in the length of the wood portion to form a cord and a pair of widened portions at either end of the longitudinal portion to form a pair of plugs. The plugs positively contain the wood portion and the cord maintains a connection between the plugs in case of breakage of the wood portion. The filling material is preferably selected such that it does not alter the hitting properties of the baseball bat. In some embodiments, the filling material is a polymeric material applied to the hole in a molten state and allowed to cure. In some embodiments, the filling material is a mixture of multiple components.

In one embodiment, the baseball bat includes a wooden portion formed from a single piece of wood and a filling material. The wooden portion includes a gripping portion having a gripping cross sectional area and terminating in a handle end. The wooden portion also includes a hitting portion having a hitting cross sectional area greater than the gripping cross sectional area and terminating in a barrel end opposite the handle end. The wooden portion further includes a connecting portion connecting the gripping portion and the hitting portion. The filling material fills a longitudinal hole extending an entire length of the bat from the handle end to the barrel end of the wooden portion to form a cord. The longitudinal hole has a hole cross sectional area. The longitudinal hole also has a first widened portion at the handle end such that the filling material in the first widened portion forms a first plug. The longitudinal hole further has a second widened portion at the barrel end such that the filling material in the second widened portion forms a second plug. The filling material is selected such that when the bat breaks upon contact with a pitched baseball, the filling material remains as a single piece and positively contains the wooden portion between the first and second plugs.

In another embodiment, a method of manufacturing a baseball bat includes the steps of drilling a longitudinal hole in a wooden portion of the baseball bat, drilling a first widened portion at the handle end of the longitudinal hole, drilling a second widened portion at the barrel end of the longitudinal hole, and applying a filling material to the longitudinal hole such that the filling material fills the longitudinal hole, at least a portion of the first widened portion, and at least a portion of the second widened portion. The wooden portion of the bat includes a gripping portion having a gripping cross sectional area and terminating in a handle end, a hitting portion having a hitting cross sectional area greater than the gripping cross sectional area and terminating in a barrel end opposite the handle end, and a connecting portion connecting the gripping portion and the hitting portion. The wooden portion is formed from a single piece of wood, and the longitudinal hole extends an entire length of the bat from the handle end to the barrel end of the wooden portion and has a hole cross sectional area.

DETAILED DESCRIPTION OF THE INVENTION

Figure 1:
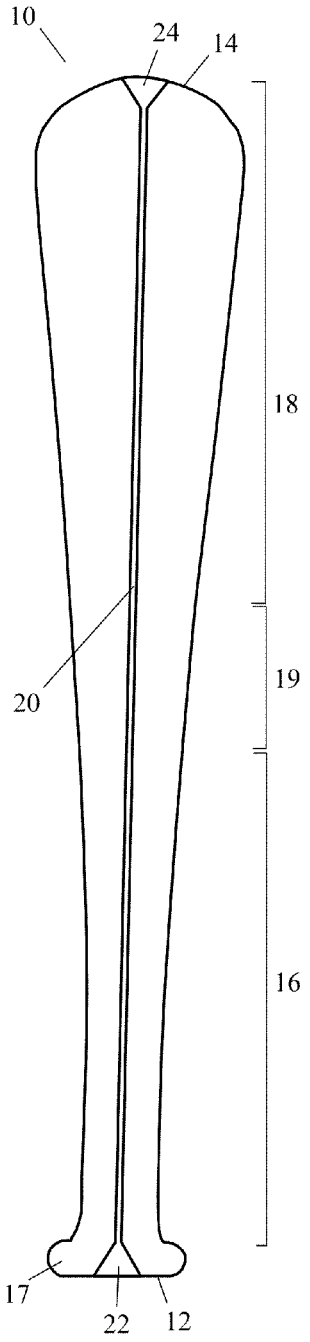
FIG. 1 shows a cross sectional view of a hollowed wooden baseball bat in an embodiment of the present invention.

The present invention addresses the continual incidences of wooden baseball bats breaking and the associated inherent dangers, risks, and harm. The incidence of a fractured or broken bat may cause a large jagged wooden projectile to become airborne, flying into the playing field or spectator area with the possibility of inflicting serious harm or injury to the unlucky recipient.

A baseball bat of the present invention is preferably designed to prevent the large severed jagged wooden fragment from leaving the batter's hands or control. The batter using a baseball bat of the present invention would maintain control of the broken fragment by continuing to hold onto or to grasp the handle of the bat. The potential flying projectile is preferably wholly contained and no longer susceptible to cause harm or injury to any player or spectator with a bat of the present invention.

A baseball bat of the present invention preferably has identical hitting properties to the baseball bat if it had not been drilled out and filled. The distribution of the weight of the bat and not just the total weight of the bat affects the hitting properties of the bat. The term "hitting properties" as used herein refers to properties including, but not limited to, bat speed when the bat is swung by a batter, bat flexibility and hardness when the bat is swung and contacts a pitched baseball, and the hitting force applied by the bat to the pitched baseball upon contact. The term "pitched baseball" as used herein refers to a conventional baseball being thrown by a human pitcher. The term "batter" as used herein refers to a human batter holding and swinging the bat in his or her hands.

In a preferred embodiment, the baseball bat contains a strong polymer material core. The polymer may be natural or synthetic. A number of materials may be used as the polymer material including, but not limited to, nylon, polycarbonate, and polyethylene, polypropylene, polystyrene, and natural or synthetic rubber. In a preferred embodiment, the polymer material is nylon. The material is preferably injected in a liquid or semi-liquid molten state to fill a central bore, where it solidifies and positively contains the bat at each end of the bat.

In a preferred embodiment, the chemical composition of the injected synthetic polymer material may be chemically formulated to approximately match the weight, density, and hardness of the wood material used to produce the bat and to have a predetermined elasticity characteristic. The polymer material may be manufactured from virgin stock or from up to 100% recycled material and may be colored to any predetermined color choice. The polymer material may be a single polymer or a blend of two or more polymers.

In a preferred embodiment of the present invention, a wooden bat is modified to have a small hole drilled through the length of its longitudinal axis. In some embodiments, the hole has a diameter of at least 1/16". In some embodiments, the hole has a diameter of 1/8" or less. In other embodiments, the hole has a diameter of 3/16" or less. In yet other embodiments, the hole has a diameter of 1/4" or less. At the handle end and at the barrel end, the hole is increased in size, preferably using countersink machining with a counterbore to widen the hole. In some embodiments, the countersink is conical in shape with a base diameter of at least 1/2", although any shape including, but not limited to, cylindrical, spherical, rectangular, or an irregular or complex shape may be used within the spirit of the present invention as long as the shape has a maximum cross sectional area greater than the cross sectional area of the longitudinal hole.

In some embodiments, the actual drilling and machining sawdust and other wood wastes is weighed and an equivalent weight of synthetic polymer material is injected into the longitudinal hole. The synthetic polymer material is heated, preferably to a temperature between 300 and 500° F., although the exact preferred temperature depends on the polymer material being used, so that it becomes molten. The molten material is injected into the drilled bat and allowed to cool and cure, thereby creating a small but strong and flexible dowel positively containing the bat between its ends. The longitudinal hole is preferably cut roughly so that the injected polymer bonds and coheres to the wood pores and fibers along the length of the hole to strengthen the bat, most particularly at the narrow handle area. The cured polymer filling collectively bonds to the wood and holds the wood longitudinally together in the event of a structural fracture.

Once the injected polymer has cooled and cured, the bat ends may be finished or machine milled as they would be in a conventional production process.

The drilling, machining, and injection processes preferably do not alter the hitting or striking characteristics of the bat such that it swings and it interacts with a baseball in a substantially identical manner to how it would had it not been drilled and filled. No laminated, composite, glued, or other man-made structural surface component comes into actual contact with a baseball when struck. Preferably, no measurable advantage or disadvantage in the playability or "sweet spot" of the bat is produced by the modifications.

FIG. 1 shows a solid wooden bat 10 with a handle end 12, a barrel end 14, a gripping portion 16 terminating in a knob 17, a striking portion 18, and a middle portion 19 between the gripping porting 16 and striking portion 18. A cylindrical hole 20 has been drilled along the longitudinal core of the bat from the handle end to the barrel end. The hole is preferably sized so that it is as small as possible while being large enough to permit molten polymer material to be forced through its length and to provide a cured solid polymer cord large enough in cross sectional area so that it does not break into two pieces when the bat breaks. In FIG. 1, the hole is approximately 1/8" in diameter and located approximately in the center of the bat, although the hole may be offset from the center slightly within the spirit of the present invention. The hole is preferably drilled with a rough drill bit so that the edges of the hole are uneven and include extending wood fibers. A first widened portion 22 at the handle end 12 of the bat connects to the cylindrical hole 20 at the handle end. A second widened portion 24 at the barrel end 14 connects to the cylindrical hole 20 at the barrel end. The widened portions are preferably formed using a counterbore. The widened portions may be formed before or after the longitudinal hole is drilled. Although the widened portions in FIG. 1 have a conical shape at approximately a 45-degree angle with a 5/8" diameter at the base, other angles and other shapes may be used within the spirit of the present invention as long as the cross sectional area at the largest portion of the cured polymer in the widened portions 22, 24 is larger than the cross sectional area of the cured polymer in the hole 20. The wooden bat 10 preferably would meet current Major League baseball specifications if not for the drilled cylindrical hole 20 and widened portions 22, 24. The official rules of Major League baseball are available at http://mlb.mlb.com/mlb/official_info/official_rules/foreword.jsp, and are hereby incorporated herein by reference.

Figure 2:
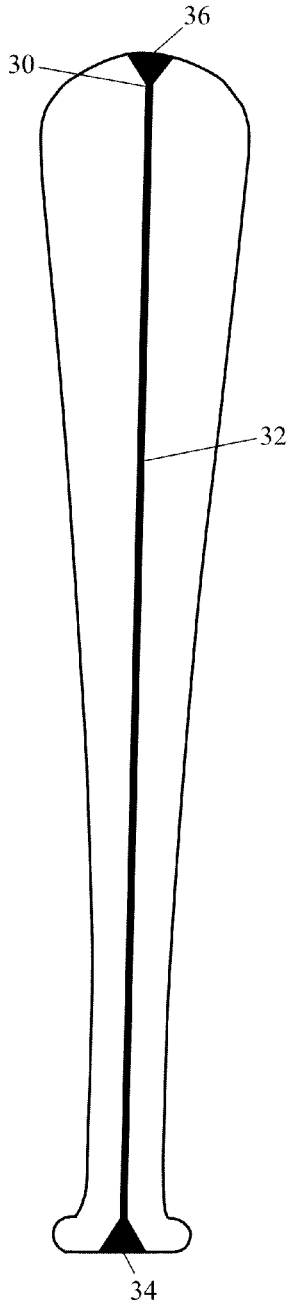
FIG. 2 shows the baseball bat of FIG. 1 filled with a polymer material.

FIG. 2 shows the wooden baseball bat of FIG. 1 after it has been filled with a molten polymer material 30 which has been allowed to cool and cure. Once the material 30 has cooled, the central portion 32 serves as a cord and the end portions 34, 36 serve as plugs to prevent the cord from coming out of the hole 20 when the bat breaks. The molten material is preferably applied slowly to the hole 20 to minimize or substantially eliminate the formation of bubbles or other void space within the hole which would reduce the interfacial bonding with the wood or reduce the strength of the central cord portion. Although FIG. 2 shows both widened portions being completely filled with polymer, one or both widened portions may be only partially filled with polymer material. Another material may be placed at the barrel end or the handle end to make the surface more sandable, paintable, aesthetically pleasing, or wood-like within the spirit of the present invention.

The filling material preferably has the following properties. It preferably has a density within 5% of the density of the wood of the bat. More preferably its density is within 1% of the density of the wood. Most preferably its density is substantially identical to the density of the wood. The filling material is preferably meltable at elevated temperatures so that it flows through the hole under pressure and cools to a solid at room temperature. The filling material may be a single material including, but not limited to nylon, polyethylene, polypropylene, or polycarbonate, or a mixture of materials selected to have a predetermined density, tensile strength, elasticity, or interfacial bonding with the wood of the bat. Wood fibers, graphite, or other non-polymeric materials may be used in a filling mixture within the spirit of the present invention. The filling material is preferably flexible enough that it does not prevent the bat from flexing and strong enough so that the formed cord remains in one piece when the bat breaks.

Figure 3:
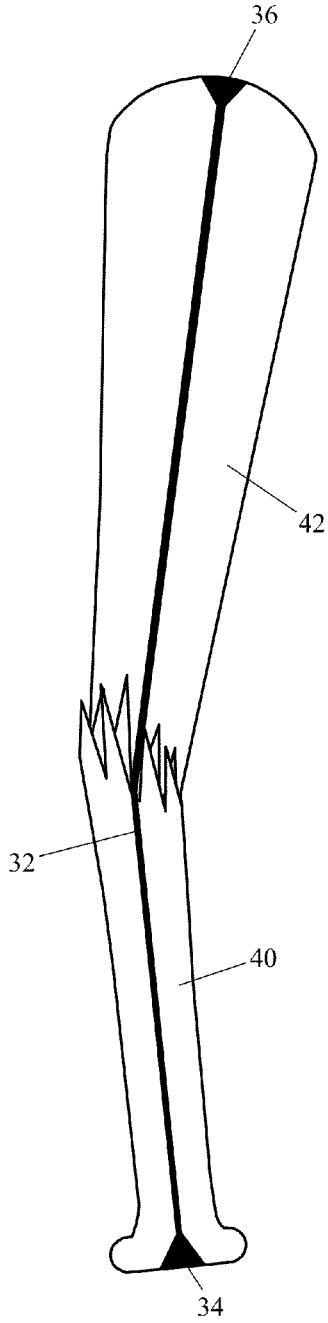
FIG. 3 shows the baseball bat of FIG. 2 after breaking.

FIG. 3 shows the bat of FIG. 2 after it has been broken into a handle portion 40 and a barrel portion 42 by contact with a pitched baseball in the narrowed portion between the gripping portion 16 and the striking portion 18, although the bat may break anywhere along its length with a similar result with a bat of the present invention. The cord portion 32 stretches and bends but does not break when the wood portion of the bat breaks, and the plug portions 34, 36 as well as the interfacial bonds with the wood in the hole portion 20, prevent the barrel portion 42 from becoming airborne. The batter is left holding the entire bat in his hands with no risk of injury to others by a flying barrel.

With a bat of the present invention, the American tradition of professional baseball along with its legendary 125-year old history of manufacturing natural solid hardwood baseball bats may be continued with a bat of the present invention with the sport being safer for both players and spectators.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of manufacturing a baseball bat comprising the steps of:

a) drilling a longitudinal hole in a wooden portion of the baseball bat;

wherein the wooden portion comprises a gripping portion having a gripping cross sectional area terminating in a handle end, a hitting portion having a hitting cross sectional area greater than the gripping cross sectional area and terminating in a barrel end opposite the handle end, and a connecting portion connecting the gripping portion and the hitting portion;

wherein the wooden portion is formed from a single piece of wood; and wherein the longitudinal hole extends an entire length of the bat from the handle end to the barrel end of the wooden portion and has a hole cross sectional area;

b) drilling a first widened portion at the handle end of the longitudinal hole;

c) drilling a second widened portion at the barrel end of the longitudinal hole; and d) applying a filling material to the longitudinal hole such that the filling material fills the longitudinal hole, at least a portion of the first widened portion, and at least a portion of the second widened portion, the filling material thereby forming a cord in the longitudinal hole, a first plug integral with the cord in the first widened portion, and a second plug integral with the cord in the second widened portion;

wherein the filling material is applied to the longitudinal hole at an elevated temperature such that the filling material is molten at the elevated temperature and cools at an ambient temperature to a solid;

wherein the filling material is selected such that when the bat breaks upon contact with a pitched baseball, the filling material remains as a single piece and positively contains the wooden portion between the first and second plugs.

2. The method of claim 1 further comprising the step of forming the wooden portion from the single piece of wood.

3. The method of claim 1, wherein steps b) and c) are performed using countersink machinery.

4. The method of claim 1, wherein the filling material fills the first widened portion, and the second widened portion.

5. A method of manufacturing a baseball bat comprising the steps of:

a) drilling a longitudinal hole in a wooden portion of the baseball bat;

wherein the wooden portion comprises a gripping portion having a gripping cross sectional area terminating in a handle end, a hitting portion having a hitting cross sectional area greater than the gripping cross sectional area and terminating in a barrel end opposite the handle end, and a connecting portion connecting the gripping portion and the hitting portion;

wherein the wooden portion is formed from a single piece of wood; and wherein the longitudinal hole extends an entire length of the bat from the handle end to the barrel end of the wooden portion and has a hole cross sectional area;

b) drilling a first widened portion at the handle end of the longitudinal hole;

c) drilling a second widened portion at the barrel end of the longitudinal hole; and d) applying a filling material to the longitudinal hole such that the filling material fills the longitudinal hole, at least a portion of the first widened portion, and at least a portion of the second widened portion;

wherein the filling material is applied at an elevated temperature such that the filling material is molten at the elevated temperature and cools at an ambient temperature to a solid such that the filling material in the longitudinal hole forms a cord, the filling material in the first widened portion forms a first plug, and the filling material in the second widened portion forms a second plug.

6. The method of claim 5 further comprising the step of forming the wooden portion from the single piece of wood.

7. The method of claim 5, wherein the filling material is selected such that when the bat breaks upon contact with a pitched baseball, the cord remains as a single piece and positively contains the wooden portion between the first and second plugs.

8. The method of claim 5, wherein steps b) and c) are performed using countersink machinery.

9. The method of claim 5, wherein the filling material comprises a polymeric material selected from the group consisting of:

a) nylon;

b) polyethylene; and c) polycarbonate.

10. The method of claim 5, wherein the filling material has a density within 5% of a density of the wooden portion.

11. The method of claim 5, wherein the filling material has a density within 1% of the density of the wooden portion.

12. The method of claim 5, wherein the filling material has a density substantially equal to the density of the wooden portion.

13. The method of claim 5, wherein the longitudinal hole has a diameter less than 3/16".

14. The method of claim 5, wherein the longitudinal hole has a diameter of about 1/8".

15. The method of claim 5, wherein the first plug and the second plug each has a maximum cross sectional area of at least 1/2".

16. The method of claim 5, wherein the first plug and the second plug each has a maximum cross sectional area of at least 5/8".

17. The method of claim 5, wherein the first widened portion and the second widened portion each has a shape selected from the group consisting of:

a) a cone;

b) a cylinder; and c) a hemisphere.

* * * * *